US006254496B1

(12) United States Patent
Maehara et al.

(10) Patent No.: US 6,254,496 B1
(45) Date of Patent: Jul. 3, 2001

(54) DIMPLED GOLF BALL AND DIMPLE DISTRIBUTING METHOD

(75) Inventors: Kazuto Maehara; Keisuke Ihara; Atsuki Kasashima, all of Chichibu (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/466,809

(22) Filed: Dec. 20, 1999

(30) Foreign Application Priority Data

Dec. 25, 1998 (JP) ..... 10-368835

(51) Int. Cl.[7] ..... A63B 37/12; A63B 37/14

(52) U.S. Cl. ..... 473/378; 473/383

(58) Field of Search ..... 473/351, 365, 473/377, 378, 379, 380, 381, 382, 383, 384, 371

(56) References Cited

U.S. PATENT DOCUMENTS

| | | | | |
|---|---|---|---|---|
| 4,720,111 | * | 1/1988 | Yamada | 473/382 |
| 4,869,512 | * | 9/1989 | Nomura et al. | 273/232 |
| 4,874,169 | * | 10/1989 | Litchfield | 273/60 R |
| 5,033,750 | * | 7/1991 | Yamagishi et al. | 273/232 |
| 5,688,194 | | 11/1997 | Stiefel et al. . | |
| 5,772,532 | | 6/1998 | Stiefel et al. . | |

* cited by examiner

*Primary Examiner*—Mark S. Graham
*Assistant Examiner*—Alvin A Hunter
(74) *Attorney, Agent, or Firm*—Sughrue, Mion, Zinn, Macpeak & Seas, PLLC

(57) ABSTRACT

In a golf ball having a plurality of dimples in its surface, the dimples as a whole are randomly distributed on at least a hemispherical surface. The golf ball has improved aerodynamic isotropy.

9 Claims, 6 Drawing Sheets

DIMPLED GOLF BALL AND DIMPLE DISTRIBUTING METHOD

This invention relates to a dimpled golf ball having improved aerodynamic isotropy and covering equal distance, and a method for distributing a plurality of dimples on a golf ball.

BACKGROUND OF THE INVENTION

Current golf balls have dimples in their surface. For the dimple distribution, regular octahedral, regular icosahedral and regular polyhedral arrangements are generally employed. A spherical surface is divided as a regular polyhedron to define surface units, typically triangular surface units, where dimples are arranged. These arrangements are effective in enabling easy dimple design and mold manufacture and achieving good aerodynamic isotropy.

These arrangements, however, have the following problem. In the respective surface units, dimples are arranged in the same pattern, that is, the same pattern is repeated. The patterns are regular so that the dimples and the lands between dimples (i.e., surface areas where no dimples are formed) are arranged in a regular manner. In one example, dimples and lands are arranged in a row. A golf ball having dimples repetitively arranged in the same pattern exhibit different aerodynamic properties depending on the axis of rotation which varies with a particular point of impact, leading to variations of distance. The dimple arrangement based on the above-described units encounters a limit in closely distributing dimples and is hardly regarded as exerting maximum aerodynamic performance.

More particularly, it was found that the dimple arrangement based on the above-described units has the problem that aerodynamic properties largely differ whether or not the boundary between the units is coincident with the direction of rotation. This is because the units are large. The difference of aerodynamic properties is very significant between hemispheres which are regarded as the maximum unit in the prior art arrangement method. The difference of aerodynamic properties between equatorial rotation and longitudinal rotation is large enough to be perceivable in an actual hitting test and demonstrated by the measurement results of a swing machine test.

A number of approaches have been proposed for eliminating such a difference of aerodynamic properties, but none of them have given a sweeping solution. Since all these approaches are halfway measures to correct the difference while maintaining the arrangement units unchanged, they fail to significantly improve aerodynamic isotropy.

SUMMARY OF THE INVENTION

An object of the invention is to provide a golf ball having improved aerodynamic isotropy and covering equal distance. Another object of the invention is to provide a method for distributing a plurality of dimples on a golf ball so as to give a full solution to the aerodynamic anisotropy.

In a first aspect, the invention provides a golf ball having a plurality of dimples in its surface. The dimples as a whole are randomly distributed on at least a hemispherical surface. In preferred embodiments, the dimples are circular or non-circular or both in plane shape, the dimples are different in diameter or depth or both, and the dimples each have an area of 3 to 30 $mm^2$ when projected on a plane.

In a second aspect, the invention provides a method for arranging a plurality of dimples on a golf ball, comprising the steps of initially distributing the plurality of dimples on a surface of a computer golf ball model, selecting one dimple and performing on the one dimple at least one alteration selected from movement and rotation of the one dimple and geometrical enlargement or contraction of dimples such that the sum of the squares of boundary spherical distances between the one dimple and adjacent dimples may be minimum and the dimples may not overlap each other, and iterating the alteration on the remaining dimples.

The alteration operation is terminated when the value of Sk is smaller than a desired convergence criterion value, said Sk being given by the equation:

$$Sk = \sum_{i=1}^{N} \sum_{j=1}^{Mi} Lij^2$$

wherein i, j and k are counters, Sk is the sum of the squares of distances between adjacent dimples, calculated for all the dimples, 1 is added to k whenever optimization is performed on all the dimples, N is the total number of dimples, Mi is the number of dimples adjoining an i-th dimple, and Lij is the distance between an i-th dimple and a i-th dimple among a Mi number of dimples adjoining the i-th dimple. The dimple distribution thus obtained provides a dimple arrangement on the golf ball.

In the golf ball of the invention, dimples are randomly arranged. Differently stated, regularity is eliminated from the arrangement of a plurality of dimples constituting a unit. As a result, the dimpled golf ball is improved in both aerodynamic performance and aerodynamic isotropy. The aerodynamic properties do not substantially differ among different points of impact. The ball covers equal distance regardless of the point of impact.

When a box containing a plurality of balls is vibrated, the balls pack randomly and closely. Simulating this phenomenon in a simplified manner on a computer, the dimple distributing method of the invention determines the final arrangement that satisfies the above converging condition. The method of the invention ensures that a golf ball having dimples randomly and closely arranged and exhibiting improved aerodynamic performance and aerodynamic isotropy is manufactured in a simple manner.

DESCRIPTION OF THE PREFERRED EMBODIMENTS

Figure 1:
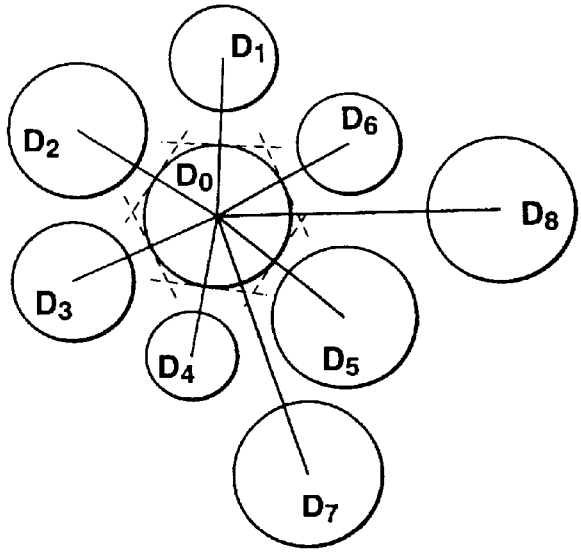
FIG. 1 schematically illustrates dimples of circular shape for explaining the definition of adjacent dimples.

The golf ball of the invention has a plurality of dimples formed in its surface. The dimples as a whole are randomly distributed on at least a hemispherical surface.

According to the invention, the dimple arrangement does not possess regularity as in the prior art polyhedral arrangements such as octahedral and icosahedral arrangements and instead, the position and size (or diameter) of dimples having a circular plane shape or the major axis direction of dimples having a non-circular plane shape, and the position and shape of lands are random. By the random distribution of dimples as a whole, it is meant that dimples are randomly distributed in an overall view, permitting the inclusion of some dimples which are regularly distributed by chance.

The random dimple distribution covers at least a hemispherical surface of a golf ball, and preferably the entire spherical surface. When the random dimple distribution is established on a hemispherical surface, the same distribution may be set on the other hemispherical surface.

In the practice of the invention, the dimple may be of any desired plane shape. Included are dimples of circular plane shape (simply referred to as circular dimples, hereinafter) as well as dimples of non-circular plane shapes, for example, oval, triangular, rhombic, rectangular, pentagonal, polygonal, and star shapes. Of these, circular dimples are preferred. A mixture of circular dimples and non-circular dimples is also acceptable.

In one preferred embodiment, each dimple has an area of 3 to 30 $mm^2$ and especially 4 to 18 $mm^2$ when projected on a plane. In this embodiment, circular dimples each have a diameter in the range of 1.9 to 6.2 mm and especially 2.1 to 4.8 mm. The depth of dimples is preferably selected in the range of 0.1 to 0.3 mm and especially 0.13 to 0.25 mm.

The number of dimples is determined as appropriate although the recommended number is from 300 to 650, more preferably from 318 to 542, and further preferably from 360 to 500. The dimple surface coverage is preferably 50 to 95%, more preferably 65 to 90%, and further preferably. 70 to 85%. Here the dimple surface coverage is the sum $S_1$ of the areas of dimples projected on a plane, divided by the surface area So of an imaginary golf ball sphere provided that the golf ball has no dimples formed therein, that is, $(S_1/S_0)\times 100\%$.

For the dimple distribution according to the invention, it is preferred to use dimples of at least two types which are different in diameter and/or depth or other parameter. It is more preferred to use dimples of three to thirty types, especially three to fifteen types, which are different in diameter.

The golf ball having dimples randomly distributed is achieved by the method comprising the steps of initially distributing a predetermined number of dimples on a surface of a computational golf ball model; selecting one dimple and performing on the one dimple at least one alteration selected from movement and rotation of the one dimple and geometrical enlargement or contraction of dimples such that the sum of the squares of boundary spherical distances between the one dimple and adjacent dimples may be minimum and the dimples may not overlap each other, iterating the alteration on the remaining dimples, and terminating the alteration operation when the value of Sk (as defined herein) is smaller than a desired convergence criterion value. The dimple distribution thus obtained is used as the dimple arrangement on the golf ball.

The number and plane shape of dimples are predetermined before the onset of the above method. Based on the predetermined number and predetermined plane shape of dimples, the dimple arrangement is determined. The diameter (or size) of dimples is altered from the initially set diameter (or size) by the operation of optimizing the dimple shape. Then it can happen that every dimple has a different diameter (or size). From the mold fabrication standpoint, however, the dimple diameter is preferably altered within the range of 1.9 to 6.2 mm, and more preferably 2.1 to 4.8 mm. In an alternative preferred practice, two to thirty types, more preferably two to fifteen types, and further preferably two to ten types of dimples are selected within the above-described diameter range, and the dimple diameter is altered within this range.

Figure 2:
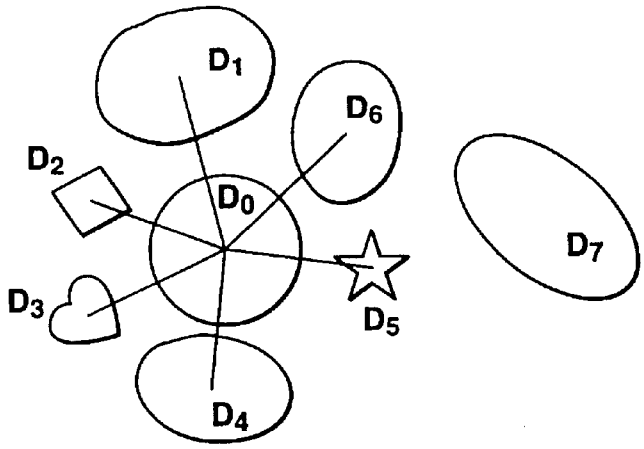
FIG. 2 schematically illustrates dimples of different shapes for explaining the definition of adjacent dimples.

In the dimple arrangement according to the invention, the relationship between one dimple and adjacent dimples is important. The term "adjacent dimples" used herein is defined as follows. Referring to FIG. 1, there are illustrated a plurality of dimples $D_0$ to $D_8$. With a focus on one arbitrary dimple $D_0$, a plurality of dimples $D_1$ to $D_6$ are distributed so as to surround the one dimple $D_0$. A group of planes (depicted by broken lines) that perpendicularly bisect the line segments (depicted by solid lines) connecting the center of one dimple $D_0$ and the centers (or centroids) of dimples $D_1$ to $D_6$ or the shortest line segments connecting one dimple $D_0$ and dimples $D_1$ to $D_6$ define a minimum multiangular cylindrical region surrounding one dimple $D_0$. Those dimples $D_1$ to $D_6$ used to form the cylindrical region are defined as being adjacent to one dimple $D_0$. In FIG. 1, dimples $D_7$ and $D_8$ are not regarded as being adjacent to one dimple $D_0$ because the bisectors associated with these dimples $D_7$ and $D_8$ do not define the minimum multiangular cylindrical region. The same definition applies to dimples of different shapes as shown in FIG. 2.

Figure 5:
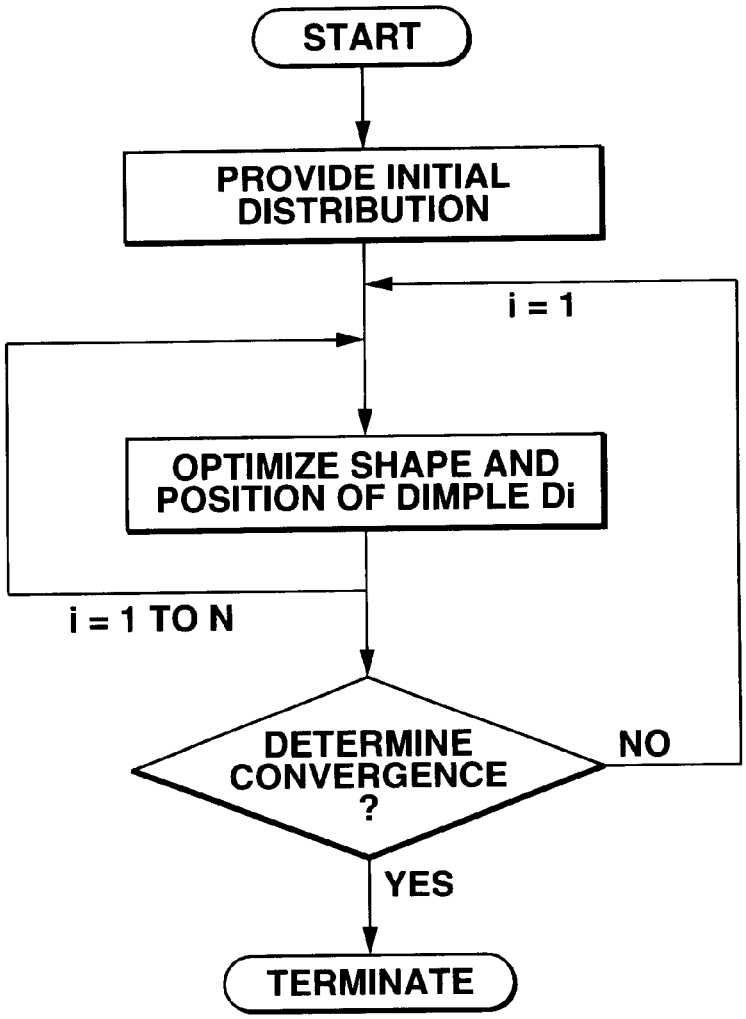
FIG. 5 is a block diagram illustrating the dimple arrangement method of the invention.

The dimple distribution method according to the invention is described in more detail. The algorithm for the dimple distribution method is illustrated in the block diagram of FIG. 5.

(1) Initial Distribution of Dimples

Figure 3:
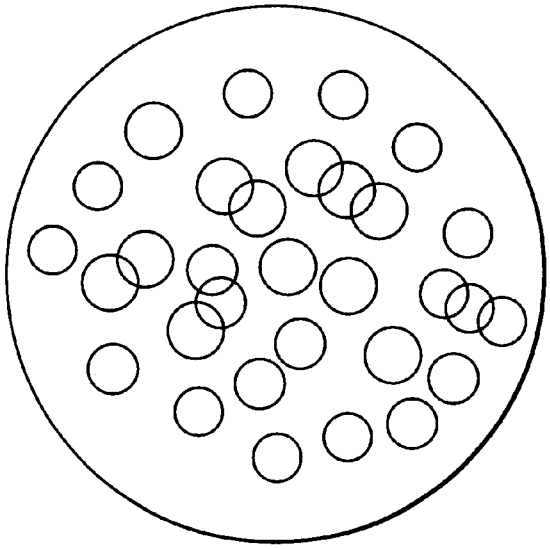
FIG. 3 schematically illustrates one exemplary initial distribution of dimples.

First of all, a predetermined number of dimples are distributed on a surface of a computer golf ball model. The initial distribution may be performed by various methods. For example, an appropriate initial distribution is performed using a random function. Alternatively, well-known arrangement methods such as octahedral and icosahedral arrangement methods are used to provide the initial distribution. When the initial distribution is provided by a well-known arrangement method, the convergent time is reduced. In the embodiment wherein an appropriate initial distribution is performed using a random function, some dimples overlap each other in many cases, as shown in FIG. 3 In this case, it is preferred that the shape of dimples has a small diameter so that the overlapped area between dimples is less than a quarter of the area of each of the dimples.

(2) Optimization of the Shape and Position of i-th Dimple

In the initial distribution, a focus is placed on one dimple $D_i$. On one dimple $D_i$, at least one alteration selected from movement and rotation and geometrical enlargement or contraction is performed such that the sum of the squares of boundary spherical distances between one dimple $D_i$ and adjacent dimples may be minimum and the dimples may not overlap each other, thereby reducing the distance between dimples. The alteration operation performed on one dimple $D_i$ may be only movement, or movement followed by any other alteration operation. Alternatively, two or more alteration operations may be performed at the same time.

Figure 4:
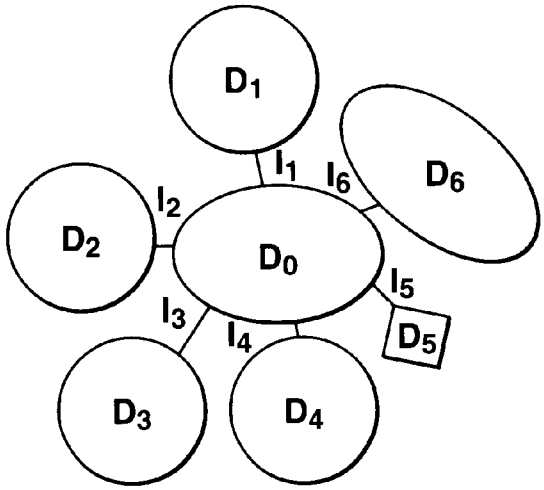
FIG. 4 schematically illustrates dimples for explaining how to determine the boundary spherical distance between dimples.

Referring to FIG. 4, the alteration operation is described. Optimization is done on one dimple $D_0$ such that the sum of the squares of boundary-to-boundary spherical distances (not center-to-center distances) between one dimple $D_0$ and adjacent dimples $D_1$ to $D_6$, given by $$\sum_{j=1}^{6} lj^2$$

wherein lj is the distance between dimple $D_0$ and adjacent dimple $D_j$, may be minimum.

Next a subsequent dimple is selected and the same alteration operation as above is performed thereon. It is not critical how to select the subsequent dimple. For example, selection may be made (i) in the clockwise or counterclockwise, helical order, (ii) in the longitudinal or latitudinal order, or (iii) randomly.

(3) Convergence Determination

After the shape and position of dimples are optimized in the above-described manner, convergence is determined. This determination is done by comparing the value of Sk with a desired convergence criterion value (epsa). If Sk<epsa, the algorithm determines convergence termination. If Sk≧epsa, the algorithm returns to the initial dimple and iterates the operation (2) of optimizing the shape and position of dimples.

Sk is given by the equation:

$$Sk = \sum_{i=1}^{N} \sum_{j=1}^{Mi} Lij^2$$

wherein subscripts i, j and k are counters, Sk is the sum of the squares of distances between adjacent dimples, calculated for all the dimples, 1 is added to k on every cycle when optimization is performed on all the dimples, N is the total number of dimples, Mi is the number of dimples adjoining an i-th dimple, and Lij is the distance between an i-th dimple and a j-th dimple among a Mi number of dimples adjoining the i-th dimple.

The desired convergence criterion value (epsa), which differs with the total number of dimples and other parameters, is preferably selected in the range of 1,500 to 5,000 $mm^2$, and more preferably 2,000 to 3,700 $mm^2$.

It is understood that convergence determination may also be made in terms of a harmonic mean of Sk or a relative variate thereof.

In the operation (2) of optimizing the shape and position of dimples, it is effective that a choice among movement, rotation, and enlargement/contraction is switched to another one on every all-dimple-processing counter k. A predictable deformation may be provided by introducing the weight concept.

If there are some dimples which are not desired to move, for example, those dimples formed by the inner ends of support pins in a mold, they can be kept fixed by skipping the above-described alteration operation.

Where a two-segment mold is used in molding a golf ball as is often the case, it is necessary to set a great circle or equator. In this case, a hemisphere is designed using the great circle as the boundary condition. Therefore, the dimple distribution method of the invention may be carried out on either an entire spherical surface or a hemispherical surface. When a dimple distribution is established on one hemispherical surface, the same dimple distribution may be provided on the other hemispherical surface.

With the above-described dimple arrangement method, the depth of dimples is not determined. After dimple distribution is determined as described above, the depth may be selected as appropriate within the above-described range in accordance with the size of the respective dimples.

The golf ball resulting from the above-described determination of dimple arrangement has dimples as a whole randomly distributed on at least a hemispherical surface thereof. Although a regular polyhedral arrangement is utilized as the initial distribution, the regularity is disordered to provide a random distribution.

Next, referring to FIGS. 6 to 10, one specific example of the invention is described. FIGS. 6 to 10 are plan views of a golf ball as viewed from above its pole.

EXAMPLE

Figure 6:
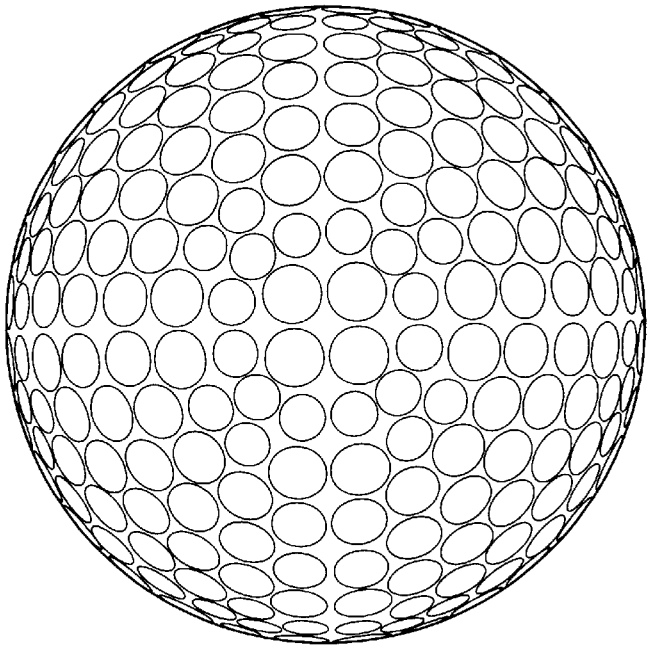
FIG. 6 is a plan view showing the initial arrangement of dimples in one example.

It is provided that 392 dimples which are circular in plane shape are distributed on the entire spherical surface of a golf ball. Using a computer, an initial distribution of dimples is set on a hemispherical surface of a golf ball model as shown in FIG. 6. The initial distribution shown in FIG. 6 is based on the regular octahedral arrangement of dimples. Seven types of dimples having different diameters (3.15 mm at minimum and 4.0 mm at maximum) are included, and the total number of dimples is 392 as mentioned above (the north and south hemispheres each carry 196 dimples).

Figure 7:
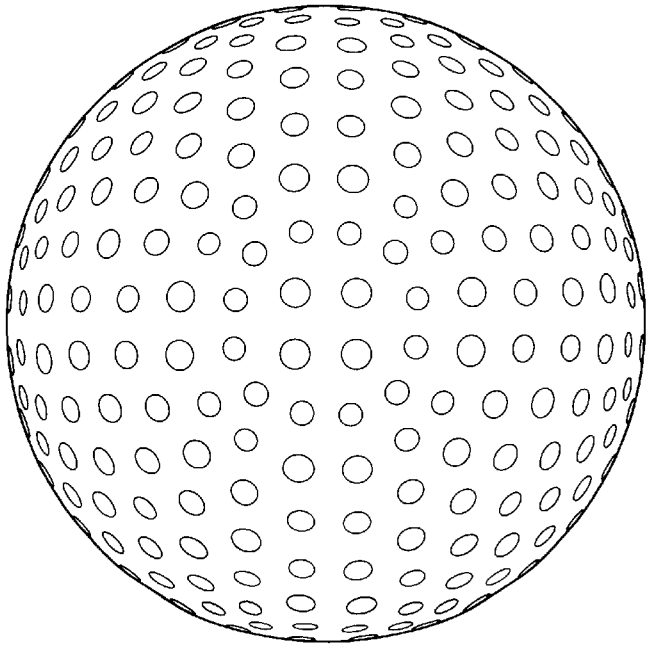
FIG. 7 is a plan view of dimples in the same initial arrangement as FIG. 6 wherein the dimple diameter is reduced to one half.

In the initial distribution, the diameters of the dimples were reduced to one half as shown in FIG. 7 while keeping the positions of the dimples unchanged from FIG. 6. This diametrical reduction was done to allow free movement of the dimples.

Figure 8:
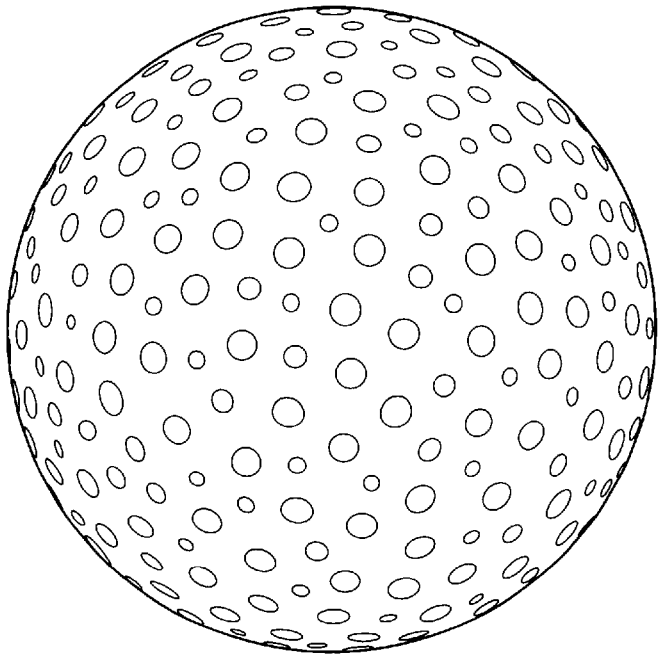
FIG. 8 is a plan view wherein the size and position of dimples are altered from those of FIG. 7 so as to provide a substantially even arrangement.
Figure 9:
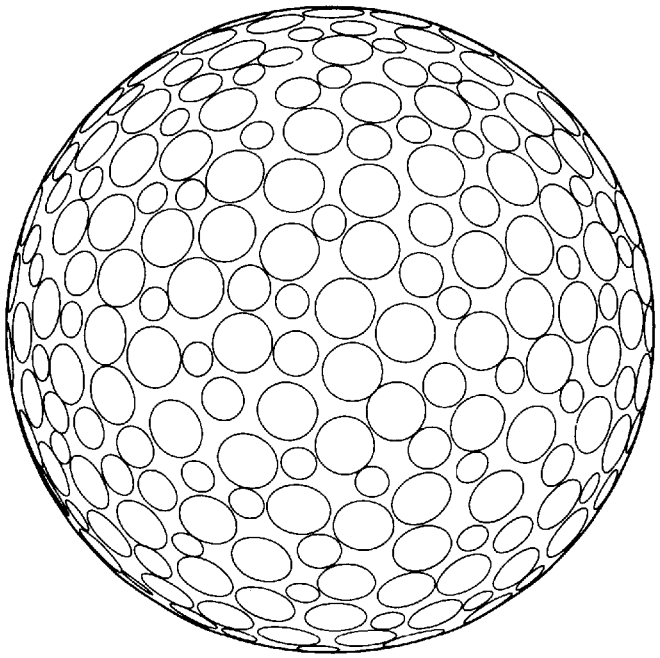
FIG. 9 is a plan view after the movement and enlargement of dimples are iterated from FIG. 8.

Next, as shown in FIGS. 8 and 9, the optimization of dimple distribution by movement of dimples was first performed in the order of a counterclockwise helical path from the dimple at the center on the hemispherical surface. The algorithm returned to the first dimple and performed the optimization of dimple shape by enlargement or contraction of dimple diameter in the same order. A dimple distribution as shown in FIG. 10 was obtained in this way.

By altering the size and position of the dimples shown in FIG. 7, a substantially uniform distribution of dimples as shown in FIG. 8 was reached. By iterating movement and enlargement of dimples from the state of FIG. 8, the dimples were randomly and closely packed as shown in FIG. 9. That is, FIG. 9 is a state just prior to the convergence. FIG. 10 is the converged result wherein the Sk value is 3,000 $mm^2$. The desired convergence criterion value (epsa) is set at 3,000 $mm^2$. When the Sk value was determined to be smaller than the epsa value, the operation of optimizing the shape and position of dimples was terminated.

Figure 10:
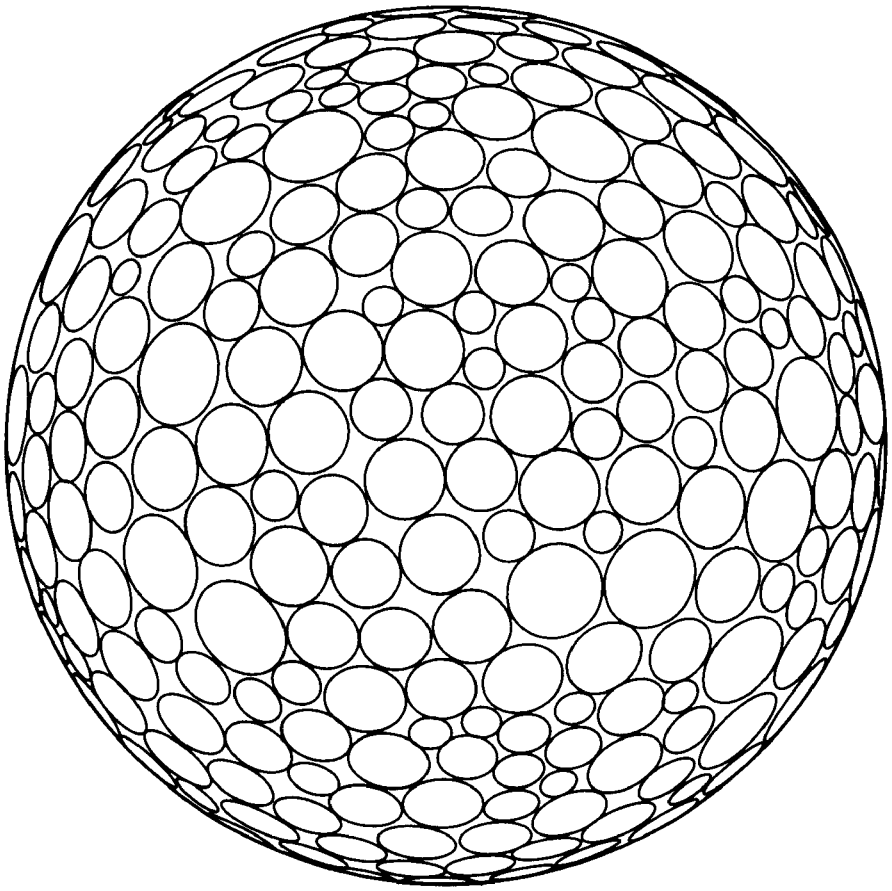
FIG. 10 is a plan view showing the final dimple arrangement on the golf ball.

In the dimple arrangement of FIG. 10, the minimum dimple diameter was 2 mm, the maximum dimple diameter was 5 mm, and the dimple surface coverage was 80%. The dimple depth was 0.14 mm at minimum and 0.24 mm at maximum.

There has been described a dimpled golf ball having improved aerodynamic isotropy.

Japanese Patent Application No. 10-368835 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for arranging a plurality of dimples on a golf ball, comprising the steps of:

initially distributing the plurality of dimples on a surface of a computer golf ball model, selecting one dimple and performing on the one dimple at least one alteration selected from movement and rotation of the one dimple and geometrical enlargement or contraction of dimples such that the sum of the squares of boundary spherical distances between the one dimple and adjacent dimples may be minimum and the dimples do not overlap each other, iterating the alteration on the remaining dimples, and terminating the alteration operation when the value of Sk is smaller than a desired convergence criterion value, said Sk being given by the equation:

$$Sk = \sum_{i=l}^{N} \sum_{j=1}^{Mi} Lij^2$$

wherein i, j and k are counters, Sk is the sum of the squares of distances between adjacent dimples, calculated for all the dimples, 1 is added to k whenever optimization is performed on all the dimples, N is the total number of dimples, Mi is the number of dimples adjoining an i-th dimple, and Lij is the distance between an i-th dimple and a j-th dimple among a Mi number of dimples adjoining the i-th dimple, the dimple distribution thus obtained providing a dimple arrangement on the golf ball.

2. The method for arranging a plurality of dimples of claim 1 wherein convergence criterion value is in the range of 1,500 to 5,000 $mm^2$.

3. The method for arranging a plurality of dimples of claim 1, wherein in the step of said initially distributing the plurality of dimples on a surface of a computer golf ball model, diameters of the dimples are reduced to a ratio thereof for keeping the position of the dimples on the surface of the golf ball.

4. The method for arranging a plurality of dimples of claim 1, wherein the one dimple which is first selected is set substantially at the center on the hemispherical surface of the golf ball model.

5. The method for arranging a plurality of dimples of claim 4, wherein an optimization of dimple distribution in said iterating the alteration on the remaining dimples is first performed in the order of helical path from the dimple at the center on the hemispherical surface.

6. The method for arranging a plurality of dimples of claim 1, wherein the dimples have any desired plane shape including circular, oval, triangular, rhombic, rectangular, pentagonal, polygonal and star shapes.

7. The method for arranging a plurality of dimples of claim 1, wherein the dimples are formed of a circular plane shape having diameters of 1.9 to 6.2 mm.

8. The method for arranging a plurality of dimples of claim 7, wherein the dimples of three to thirty types different in diameter thereof are used.

9. The method for arranging a plurality of dimples of claim 1, wherein the number of the dimples of from 300 to 650.

* * * * *

UNITED STATES PATENT AND TRADEMARK OFFICE

CERTIFICATE OF CORRECTION

PATENT NO. : 6,254,496 B1 
DATED : July 3, 2001
INVENTOR(S) : Kazuto Maehara, Keisuke Ihara and Atsuki Kasashima It is certified that error appears in the above-identified patent and that said Letters Patent is hereby corrected as shown below:

Title page,
Item [73], change "Bridgestone Corporation" to -- Bridgestone Sports Co., Ltd. --.

Signed and Sealed this

Eighth Day of April, 2003

JAMES E. ROGAN
*Director of the United States Patent and Trademark Office*